US006221827B1

(12) United States Patent
Mendoza Cruz et al.

(10) Patent No.: US 6,221,827 B1
(45) Date of Patent: Apr. 24, 2001

(54) VISCOELASTIC BLEACHING AND DISINFECTING COMPOSTIONS

(75) Inventors: Mercedes Mendoza Cruz, Barcelona; Elisabet de Jorge, Barcelona, Vilanova i la Geltu, both of (ES)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 35 days.

(21) Appl. No.: 09/466,699

(22) Filed: Dec. 17, 1999

(30) Foreign Application Priority Data

Dec. 17, 1998 (DE) ..... 198 58 238

(51) Int. Cl.[7] ..... C11D 3/00; C11D 3/395; C11D 9/00

(52) U.S. Cl. ..... 510/380; 510/370; 510/382; 510/490

(58) Field of Search ..... 510/379, 380, 510/382, 383, 370, 367, 433, 490, 303, 339

(56) References Cited

U.S. PATENT DOCUMENTS 4,588,514 * 5/1986 Jones et al. ..... 252/98
4,743,395 * 5/1988 Leifheit ..... 252/106
5,510,047 * 4/1996 Gabriel et al. ..... 252/89.1

FOREIGN PATENT DOCUMENTS 43 33 100 * 10/1994 (DE) .
0 079 102 * 5/1983 (EP) .
0 137 551 * 4/1985 (EP) .
0 145 084 * 6/1985 (EP) .
0 156 438 * 10/1985 (EP) .
0 274 885 * 7/1988 (EP) .
0 447 261 * 9/1991 (EP) .

OTHER PUBLICATIONS

Seifen Ole Fette Washse 198 (1982) p. 373.
Happi (1986) Nov. 70.
Tens. Surf. Det. 23 (1986) p. 309.
Soap Cosm. Chem. Spec. (1990).
Euro Cosm. 1 (1994) p. 14.

* cited by examiner

*Primary Examiner*—Yogendra Gupta
*Assistant Examiner*—John M Petruncio
(74) *Attorney, Agent, or Firm*—Wayne C. Jaeschke; Glenn E. J. Murphy; Daniel S. Ortiz

(57) ABSTRACT

The invention relates to new bleaching and disinfecting compositions containing—based on the composition (a) 1 to 8% by weight of alkali metal hypochlorites,
(b) 0.1 to 2% by weight of alkali metal hydroxides,
(c) 0.1 to 2% by weight of betaines,
(d) 0.1 to 1% by weight of hydrotropes and
(e) 0.05 to 1% by weight of sequestrants, with the proviso that the quantities add up to 100% by weight with water and optionally other auxiliaries and additives. The clear compositions are viscoelastic and show inter alia high stability in storage in addition to excellent washing and bleaching performance.

17 Claims, No Drawings

VISCOELASTIC BLEACHING AND DISINFECTING COMPOSTIONS

FIELD OF THE INVENTION

This invention relates to new water-based bleaching and disinfecting compositions with viscoelastic, i.e. non-Newtonian, flow behavior containing alkali metal hypochlorites, alkali metal hydroxides, amphoteric surfactants, hydrotropes and sequestrants in defined quantity ratios.

PRIOR ART

In the past, bleaching compositions based on alkali metal hypochlorites which have a remarkable viscosity and which are therefore particularly suitable for the treatment of fibers and hard surfaces have been successfully used both in the field of textile treatment and in the field of hygiene and disinfection. The effect of the high viscosity of these compositions is that the contact time between them and the surfaces to be treated is considerably longer than in the case of commercially available liquid products which soon flow off.

There has been no shortage of attempts in the past to provide bleaching and disinfecting compositions as viscous as this. For example, it was found that certain surfactants or surfactant mixtures have a thickening effect on aqueous hypochlorite solutions. EP 0 274 885 A1 (ICI), for example, recommends the use of mixtures of linear and branched amine oxides. According to the teaching of EP 0 145 084 A1 (Unilever), mixtures of amine oxides with soaps, sarcosinates, taurides or sugar esters may also be used for this purpose. The use of amine oxides with soap or sarcosinate and other anionic surfactants, for example alkyl sulfates, alkyl ether sulfates, secondary alkane sulfonates or alkyl benzenesulfonates as thickening components is known from EP 0 079 102 A1, EP 0 137 551 A1 and EP 0 447 261 A1 (Unilever). EP 0 156 438 A1 reports on the use of alkylaryl sulfonates as thickeners in water-based bleaching compositions which contain certain stilbene dyes as optical brighteners. In addition, water-based bleaching compositions containing sodium hypochlorite and anionic surfactants are known from EP 0 447 261 A1. However, the hypochlorite concentration of these compositions is between 0.1 and 8% by weight and preferably between 0.5 and 5% by weight active chlorine. In German patent DE 43 33 100 C1, applicants have already proposed stable and sufficiently viscous water-based bleaching and cleaning compositions based on hypochlorites, fatty alcohol ether sulfates and amine oxides which contain amine oxide phosphonic acids as a compulsory component. Finally, U.S. Pat. No. 4,588,514 (Lever) relates to alkaline hypochlorite bleaching compositions which contain amine oxides and small quantities of alkyl ether sulfates and soaps as viscosity regulators. However, all the known products mentioned above are attended by the disadvantage of Newtonian flow behavior, i.e. the velocity gradient is proportional to the shear stress at a given temperature which, although of advantage for the washing or bleaching process, makes dosing very difficult.

Accordingly, the complex problem addressed by the present invention was to provide new water-based bleaching and disinfecting compositions which would be distinguished by the fact that they would exhibit adequate chlorine and storage stability and would have a washing and bleaching performance at least equivalent to the products of the prior art. In addition, the products would be free from clouding and, in particular, would show viscoelastic behavior which would make them easy to dose, for example when used in washing machines, and also when applied to inclined surfaces.

BRIEF DESCRIPTION OF THE INVENTION

The present invention relates to viscoelastic bleaching and disinfecting compositions containing—based on the composition (a) 1 to 8 and preferably 2 to 6% by weight of alkali metal hypochlorites, (b) 0.1 to 2 and preferably 1 to 1.5% by weight of alkali metal hydroxides, (c) 0.1 to 2 and preferably 0.5 to 1% by weight of betaines, (d) 0.1 to 1 and preferably 0.2 to 0.5% by weight of hydrotropes and (e) 0.05 to 1 and preferably 0.1 to 0.5% by weight of sequestrants, with the proviso that the quantities shown add up to 100% by weight with water and, optionally other auxiliaries and additives.

It has surprisingly been found that the new liquid bleaching compositions not only show excellent chlorine and storage stability and improved bleaching and washing performance, they also exhibit—above all —the desired viscoelastic behavior, i.e. the flow rate of the compositions is above all a function of the shear stress or, in other words, the viscosity of the compositions only decreases significantly during shearing.

DETAILED DESCRIPTION OF THE INVENTION

Alkali Metal Hypochlorites

Alkali metal hypochlorites in the context of the invention are understood to be lithium, potassium and, in particular, sodium hypochlorite.

Alkali Metal Hydroxides

Suitable alkali metal hydroxides are potassium hydroxide and, in particular, sodium hydroxide which are preferably used to adjust the pH value of the compositions to an optimum value of 12.5 to 14.

Betaines

Betaines are known surfactants which are mainly produced by carboxyalkylation, preferably carboxymethylation, of aminic compounds. The starting materials are preferably condensed with halocarboxylic acids or salts thereof, more particularly with sodium chloroacetate, 1 mole of salt being formed per mole of betaine. The addition of unsaturated carboxylic acids, for example acrylic acid, is also possible. Information on the nomenclature and, in particular, on the difference between betaines and "true" amphoteric surfactants can be found in the article by U. Ploog. in Seifen-Ole-Fette-Wachse, 198, 373 (1982). Other overviews on this subject have been published, for example, by A. O'Lennick et al. in HAPPI, Nov. 70 (1986), by S. Holzman et al. in Tens. Surf. Det. 23, 309 (1986), by R. Bilbo et al. in Soap Cosm. Chem. Spec. Apr. 46 (1990) and by P. Ellis et al. in Euro Cosm. 1, 14 (1994). Examples of suitable betaines are the carboxyalkylation products of secondary and, in particular, tertiary amines which correspond to formula (I):

(I)

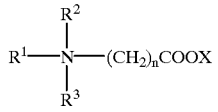

in which $R^1$ represents alkyl and/or alkenyl groups containing 6 to 22 carbon atoms, $R^2$ represents hydrogen or alkyl groups containing 1 to 4 carbon atoms, $R^3$ represents alkyl groups containing 1 to 4 carbon atoms, n is a number of 1 to 6 and X is an alkali metal and/or alkaline earth metal or ammonium. Typical examples are the carboxymethylation products of hexyl methyl amine, hexyl dimethyl amine, octyl dimethyl amine, decyl dimethyl amine, dodecyl methyl amine, dodecyl dimethyl amine, dodecyl ethyl methyl amine, $C_{12/14}$ cocoalkyl dimethyl amine, myristyl dimethyl amine, cetyl dimethyl amine, stearyl dimethyl amine, stearyl ethyl methyl amine, oleyl dimethyl amine, $C_{16/18}$ tallow alkyl dimethyl amine and technical mixtures thereof. Other suitable betaines are carboxyalkylation products of amidoamines corresponding to formula (II):

(II)

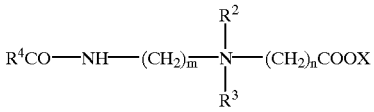

in which $R^4CO$ is an aliphatic acyl group containing 6 to 22 carbon atoms and 0 or 1 to 3 double bonds, m is a number of 1 to 3 and $R^2$, $R^3$, n and X are as defined above. Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof, with N,N-dimethyl amino-ethyl amine, N,N-dimethyl aminopropyl amine, N,N-diethyl aminoethyl amine and N,N-diethyl aminopropyl amine which are condensed with sodium chloroacetate. A condensation product of $C_{8/18}$ cocofatty acid-N,N-dimethyl aminopropyl amide with sodium chloroacetate is preferably used. Other suitable starting materials for the betaines to be used in accordance with the invention are imidazolines corresponding to formula (III):

(III)

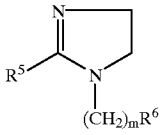

in which $R^5$ is an alkyl group containing 5 to 21 carbon atoms, $R^6$ is a hydroxyl group, an $OCOR^5$ or $NHCOR^5$ group and m is 2 or 3. These imidazolines are also known substances which may be obtained, for example, by cyclizing condensation of 1 or 2 moles of fatty acid with polyfunctional amines, for example aminoethyl ethanolamine (AEEA) or diethylenetriamine. The corresponding carboxyalkylation products are mixtures of different open-chain betaines. Typical examples are condensation products of the above-mentioned fatty acids with AEEA, preferably imidazolines based on lauric acid or $C_{12/14}$ cocofatty acid, which are subsequently betainized with sodium chloroacetate.

Hydrotropes

Hydrotropes are understood by the expert to be substances which allow the solubilization of poorly soluble substances without actually being solvents themselves. Suitable solubilizers are, in particular, sulfonates of aromatic compounds with low degrees of alkylation such as, for example, toluene sulfonate, xylene sulfonate or cumene sulfonate in the form of their alkali metal salts and mixtures thereof.

Sequestrants

If the compositions are used for the treatment of textiles, it is advisable to add to them electrolytes which act as sequestrants for heavy metal ions and which thus counteract yellowing of the washing. Suitable sequestrants are, for example, inorganic substances such as, for example, alkali metal and/or alkaline earth metal silicates, carbonates, phosphates or phosphonates and organic substances such as, for example, polyacrylic acid compounds, amine oxide phosphonic acids or lignin sulfonates. Mixtures of different sequestrants may of course also be used.

Silicates in the context of the invention are understood to be salts and esters of orthosilicic acid $Si(OH)_4$ and self-condensation products thereof. Accordingly, the following crystalline substances, for example, may be used as silicates:

(a) neosilicates (island silicates) such as, for example, phenakite, olivine and zircon;

(b) sorosilicates (group silicates) such as, for example, thortveitite and hemimorphite;

(c) cyclosilicates (ring silicates) such as, for example, benitoite, axinite, beryl, milarite, osumilite or eudialyte;

(d) inosilicates (chain and band silicates) such as, for example, metasilicates (for example diopside) or amphiboles (for example tremolite);

(e) phyllosilicates (sheet and layered silicates) such as, for example, talcum, kaolinite and mica (for example muscovite);

(f) tectosilicates (framework silicates) such as, for example feldspars and zeolites and clathrasils or dodecasils (for example melanophlogite), thaumasite and neptunite.

In contrast to the ordered crystalline silicates, silicate glasses, for example soda or potash waterglass, are preferably used. These may be of natural origin (for example montmorillonite) or may have been synthetically produced. In another embodiment of the invention, alumosilicates may also be used. Typical examples of alkali metal or alkaline earth metal silicates are sodium and/or potassium silicates with a modulus of 1.0 to 3.0 and 1.5 to 2.0.

Phosphonic acids are understood to be organic derivatives of the acid $HP(O)(OH)_2$. Phosphonates are the salts and esters of these phosphonic acids. The organic phosphonic acids or phosphonates preferably used are known chemical compounds which may be produced, for example, by the Michaelis-Arbuzov reaction. They correspond, for example, to formula (IV):

(IV)

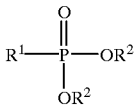

in which $R^1$ is an optionally substituted alkyl and/or alkenyl group containing 1 to 22, preferably 2 to 18 and more preferably 6 to 12 carbon atoms and $R^2$ is hydrogen, an alkali metal and/or alkaline earth metal, ammonium, alkylammonium and/or alkanolammonium or an optionally substituted alkyl and/or alkenyl group containing 1 to 22, preferably 2 to 18 and more preferably 6 to 12 carbon atoms. Typical examples are optionally hydroxy-, nitrilo- and/or amino-substituted phosphonic acids such as, for example, ethyl phosphonic acid, nitrilotris-(methylenephosphonic acid), 1-amino- or 1-hydroxyalkane-1,1-diphosphonic acids. A preferred embodiment of the invention is characterized by the use of amine oxide phosphonic acids corresponding to formula (V):

(V)

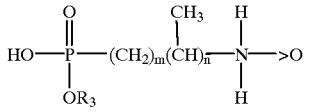

in which $R^3$ is hydrogen, a $(CH_2)_m(CHCH_3)_nNH_2O$ group or an alkali metal, m is a number of 1 to 4 and n is 0 or 1. Amine oxide phosphonic acids are builders or sequestrants which are marketed, for example, under the name of Sequion® by Bozefto (Italy). They are produced from aminophosphonic acids which are reacted to form the amine oxide. Both mono- and diamine oxides in the form of the phosphonic acids (or salts) thereof corresponding to formula (V) may be used for the purposes of the invention. Amine oxide phosphonic acids in which $R^3$ is hydrogen, m is 3 and n is 0 (amine oxide based on aminotrimethylene phosphonic acid) are preferably used.

Polyacrylic acid compounds are understood to be homopolymers of acrylic acid and methacrylic acid or esters thereof. Besides the acids, esters of the acids with alcohols containing 1 to 4 carbon atoms may also be polymerized. Polyacrylic acid compounds with a particularly advantageous stabilizing effect are present as alkali metal salts and have an average molecular weight of 1,000 to 10,000 and more particularly, 4,000 to 6,000 dalton. A suitable modified polyacrylate is Norasol® 470 N (Rohm & Haas, Germany)—a polyphosphonoacrylate with a molecular weight of 3,500 dalton.

Polyols

In another preferred embodiment of the invention, the new bleaching compositions may contain polyols preferably containing 2 to 15 carbon atoms and at least two hydroxyl groups. Typical examples are:

- glycerol;
- alkylene glycols such as, for example, ethylene glycol, diethylene glycol, propylene glycol, butylene glycol and hexylene glycol and polyethylene glycols with an average molecular weight of 100 to 1000 dalton;
- technical oligoglycerol mixtures with a degree of self-condensation of 1.5 to 10, for example technical diglycerol mixtures with a diglycerol content of 40 to 50% by weight;
- methylol compounds such as, in particular, trimethylol ethane, trimethylol propane, trimethylol butane, pentaerythritol and dipentaerythritol;
- lower alkyl glucosides, more particularly those containing 1 to 8 carbon atoms in the alkyl group, for example methyl and butyl glucoside;
- sugar alcohols containing 5 to 12 carbon atoms, for example sorbitol or mannitol,
- sugars containing 5 to 12 carbon atoms, for example glucose or sucrose;
- amino sugars, for example glucamine.

The polyols may also be present in esterified or etherified form. A typical example of the latter group of compounds are the mono- and dimethyl ethers of ethylene glycol, diethylene glycol, propylene glycol and dipropylene glycol. In general, the polyols will be used in small quantities, i.e. in quantities of 0.01 to 1% by weight and preferably 0.02 to 0.5% by weight, based on the composition.

COMMERCIAL APPLICATIONS

The compositions according to the invention are generally aqueous with a non-aqueous component of, preferably, 5 to 35% by weight and, more preferably, 8 to 15% by weight and are particularly suitable for the treatment of flat textiles such as, for example, yarns, webs and, in particular, textiles. They are normally used at low temperatures, i.e. at cold-wash temperatures (ca. 15 to 25° C.). The compositions are distinguished not only by excellent stain removal, they also reliably prevent the deposition of lime and metal traces on the fibers and thus also prevent incrustation and yellowing. Although the actual use of the compositions is directed to the removal of stains during washing, they are also suitable in principle for other applications where hypochlorite solutions are used, for example for the cleaning and disinfection of hard surfaces.

The compositions may additionally contain other chlorine-stable surfactants, optical brighteners, fragrances, dyes and pigments each in quantities of 0.01 to 2% by weight, based on the composition.

Suitable chlorine-stable surfactants are, for example, alkyl sulfates, alkyl ether sulfates, amine oxides, soaps, alkyl polyglucosides and fatty alcohol polyglycol ethers.

Typical examples of suitable optical brighteners are derivatives of diaminostilbene disulfonic acid and alkali metal salts thereof. Suitable optical brighteners are, for example, derivatives of 4,4'-diamino-2,2'-stilbene disulfonic acid (flavonic acid), such as in particular the salts of 4,4'-bis-(2-anilino4-morpholino-1,3,5-triazinyl-6-amino)-stillbene-2,2'-disulfonic acid or compounds of similar structure which, instead of the morpholino group, contain a diethanolamino group, a methylamino group, an anilino group or a 2-methoxyethylamino group. Other brighteners which may be present are those of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)4'-(2-sulfostyryl)-diphenyl, methyl umbelliferone, coumarin, dihydroquinolinone, 1,3-diaryl pyrazoline, naphthalic acid amide, benzoxazole, benzisoxazole and benzimidazole systems linked by CH═CH bonds, heterocycle-substituted pyrine derivatives and the like. Mixtures of the brighteners mentioned above may also be used. Particularly preferred brighteners are naphthotriazole stilbene sulfonic acid, for example in the form of its sodium salt (Tinopal® RBS 200), distyryl biphenyl bis-(triazinylamino)-stilbene disulfonic acid (Tinopal® CDS-X) and, in particular, 4,4'-bis-(2-sulfostyryl)biphenyl disodium salt (Tinopal® CBS-X, products of Ciba). The potassium salt of 4,4'-bis-(1,2,3-triazolyl)-(2)-stilbine-2,2-sulfonic acid marketed under the name of Phorwite® BHC 766 is preferred. The compositions generally contain the optical brighteners in quantities of 1 to 5% by weight and preferably 2 to 3% by weight. Blue dyes may also be present in small quantities. A particularly dye is the tetrabenzotetraazaporphine available as Tinolux® BBS (Ciba-Geigy).

Typical examples of suitable perfumes stable to active chlorine are: citronellol (3,7-dimethyl-6-octen-1-ol), dimethyl octanol (3,7-dimethyl-1-octanol), hydroxycitronellol (3,7-dimethyloctane-1,7-diol), mugol (3,7-dimethyl-4,6-octatrien-3-ol), myrcenol (2-methyl-6-methylene-7-octen-2-ol), tetrahydromyrcenol (THM, 2,6-dimethyloctan-2ol), terpinolene (p-mentho-1,4-(8)-diene), ethyl-2-methyl butyrate, phenyl propyl alcohol, galaxolide (1,3,4,6,7,8-hexahydro4,6,6,7,8,8-hexamethyl cyclopental-2-benzopyran), tonalide (7-acetyl-1,1,3,4,4,6-hexamethyl tetrahydronaphthalene), rose oxide, linalol oxide, 2,6-dimethyl-3-octanol, tetrahydroethyl linalool, tetrahydroethyl linalyl acetate, o-sec.-butyl cyclohexyl acetate and isolone diphorenepoxide and also isoborneal, dihydroterpineol, isobomyl acetate, dihydroterpenyl acetate. Other suitable perfumes are the substances mentioned in columns 3 and 4 of European patent application EP 0 622 451 A1 (Procter & Gamble).

Suitable pigments are inter alia green chlorophthalocyanines (Pigmosol® Green, Hostaphine® Green) or yellow Solar Yellow BG 300 (Sandoz). The compositions according to the invention are prepared by stirring. The product obtained may optionally be decanted or filtered to remove foreign bodies and/or agglomerates. In addition, the compositions have a viscosity below 100 and preferably below 50 mPas, as measured at 20° C. in a Brookfield viscosimeter (spindle 1, 60 r.p.m.).

EXAMPLES

Viscosity was measured at 20° C. using a Brookfield RVT viscosimeter (spindle 1, 60 r.p.m.). To determine chlorine stability, the test mixtures were introduced into a colorless plastic bottle and stored in daylight for 4 weeks, after which the active chlorine content was determined. Bleaching and washing performance was tested against a bleachable soil (red wine). To this end, polyester/cotton fabric was soiled and treated at 30° C. (water hardness 29° dH) in a conventional Miele washing machine (program: fast wash/rinsing/spinning/rinsing/spinning/drying). The bleaching composition was used in a quantity of 200 g/15 l, the liquor load was 0.3 g/l. Brightening was photometrically determined against a white standard. Finally, the compositions were tested to determine whether they showed viscoelastic (+) or Newtonian (−) flow behavior. The optical impression was evaluated after storage for 4 weeks at 40° C., (++) signifying no clouding, (+)slight clouding and (−) distinct clouding. Formulations 1 to 6 in Table 1 correspond to the invention while formulations C1 and C2 are intended for comparison.

TABLE 1

Viscosity, storage stability, chlorine stability and cleaning performance (quantities = % by weight)

| Components | 1 | 2 | 3 | 4 | 5 | 6 | C1 | C2 |
|---|---|---|---|---|---|---|---|---|
| Sodium hypochlorite | 5.2 | 5.2 | 5.2 | 5.2 | 5.2 | 5.2 | 5.2 | 5.2 |
| Sodium hydroxide | 0.7 | 0.7 | 0.7 | 0.7 | 0.7 | 0.7 | 0.7 | 0.7 |
| Cetyl dimethyl betaine | 0.2 | 0.2 | 0.2 | 0.2 | — | 1.0 | — | 0.2 |
| Lauryl amidopropyl betaine | — | — | — | — | 0.2 | — | — | — |
| Cocofatty alcohol + 2.3EO sulfate sodium salt | — | — | — | — | — | — | 0.2 | — |
| Toluene sulfonate sodium salt | 0.2 | 0.4 | — | — | 0.4 | 0.4 | 0.4 | — |
| Xylene sulfonate sodium salt | — | — | 0.4 | — | — | — | — | — |
| Cumene sulfonate sodium salt | — | — | — | 0.4 | — | — | — | — |
| Sodium silicate[1)] | 1.1 | 1.1 | 1.1 | 1.1 | 1.1 | 1.1 | 1.1 | 1.1 |
| Polyacrylate[2)] | 0.05 | 0.05 | 0.05 | 0.05 | 0.05 | 0.05 | 0.05 | 0.05 |
| Aminooxide phosphonic acid[3)] | 0.1 | 0.1 | 0.1 | 0.1 | 0.1 | 0.1 | 0.1 | 0.1 |
| Ethylene glycol | 0.03 | 0.03 | 0.03 | 0.03 | 0.03 | 0.03 | 0.03 | 0.03 |
| Water | to 100 | | | | | | | |
| Viscosity [mPas] | 19 | 20 | 22 | 25 | 23 | 20 | 31 | 35 |
| Chlorine stability [%-rel.] | 82 | 85 | 85 | 85 | 85 | 85 | 74 | 71 |
| Washing performance [%-refl.] | 71 | 76 | 78 | 77 | 78 | 78 | 65 | 61 |
| Viscoelasticity | + | + | + | + | + | + | − | − |
| Clouding | + | ++ | ++ | ++ | ++ | ++ | ++ | − |

[1)]Modulus 1.6;
[2)]Norasol ® LMW 45 N (Rohm & Haas);
[3)]Sequion ® CLR (Bozetto)

What is claimed is:

1. A viscoelastic bleaching and disinfecting composition containing:

(a) 1 to 8% by weight of alkali metal hypochlorite, (b) 0.1 to 2% by weight of alkali metal hydroxide, (c) 0.1 to 2% by weight of betaine, (d) 0.1 to 1% by weight of hydrotrope, and (e) 0.05 to 1% by weight of sequestrant, with the proviso that the quantities add up to 100% by weight with water and optionally auxiliaries and additives.

2. The composition as claimed in claim 1, containing sodium hypochlorite.

3. The composition as claimed in claim 1 containing sodium hydroxide.

4. The composition as claimed in claim 1 containing at least one betaine selected from the group consisting of betaines of the formula:

(I)

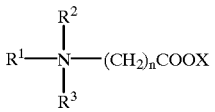

wherein $R^1$ represents an alkyl or alkenyl group containing 6 to 22 carbon atoms, $R^2$ represents hydrogen or an alkyl group containing 1 to 4 carbon atoms, $R^3$ represents an alkyl group containing 1 to 4 carbon atoms, n is a number of 1 to 6 and X is alkali metal alkaline earth metal or ammonium.

5. The composition as claimed in claim 1 containing at least one hydrotrope selected from the group consisting of toluene sulfonate, xylene sulfonate and cumene sulfonate.

6. The composition as claimed in claim 1 containing at least one sequestrant selected from the group consisting of inorganic sequestrants selectred from the group consisting of alkali metal silicates, alkaline earth metal silicates, alkali metal carbonates, alkali earth metal carbonates, alkali metal phosphonates and alkaline earth metal phophonates.

7. Compositions as claimed in at least one of claims 1 to 6 characterized in that they contain and organic sequestrants selected from the group consisting of polyacrylates, amine oxide phosphonic acids and lignin sulfonates.

8. The composition as claimed in claim 1 containing polyols.

9. The composition as claimed in claim 1 having a viscosity below 100 mPas, as measured at 20° C. in a Brookfield viscosimeter.

10. The composition of claim 2 containing sodium hydroxide.

11. The composition of claim 2 containing at least one betaine selected from the group consisting of betaines of the formula:

(I)

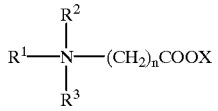

wherein $R^1$ represents an alkyl or alkenyl group containing 6 to 22 carbon atoms, $R^2$ represents hydrogen or an alkyl group containing 1 to 4 carbon atoms, $R^3$ represents an alkyl group containing 1 to 4 carbon atoms, n is a number of 1 to 6 and X is alkali metal, alkaline earth metal or ammonium and betaines of the formula:

(II)

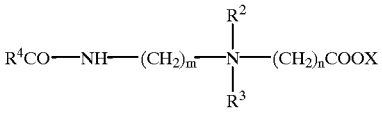

wherein $R^4CO$ is an aliphatic acyl group containing 6 to 22 carbon atoms and 0 to 3 double bonds, m is a number of 1 to 3 and $R^2$, $R^3$, n and X are as defined above.

12. The composition of claim 2 containing at least one hydrotrope selected from the group consisting of toluene sulfonate, xylene sulfonate and cumene sulfonate.

13. The composition of claim 2 containing at least one sequestrant selected from the group consisting of inorganic sequestrants selected from the group consisting of alkali metal silicates, alkaline earth metal silicates, alkali metal carbonates, Alkaline earth metal carbonates, alkali metal phosphates, alkaline earth metal phosphates, alkali metal phosphonates, and alkaline earth metal phosphonates and organic sequestrants selected from the group consisting of polyacrylates, amine oxide phosphonic acids and lignin sulfonates.

14. The composition of claim 2 containing polyols.

15. The composition of claim 10 containing at least one betaine selected from the group consisting of betaines of the formula:

(I)

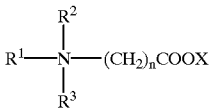

wherein $R^1$ represents an alkyl or alkenyl group containing 6 to 22 carbon atoms, $R^2$ represents hydrogen or an alkyl group containing 1 to 4 carbon atoms, $R^3$ represents an alkyl group containing 1 to 4 carbon atoms, n is a number of 1 to 6 and X is alkali metal, alkaline earth metal or ammonium and betaines of the formula:

(II)

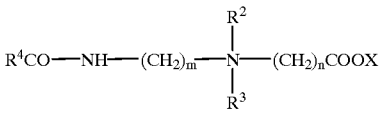

wherein $R^4CO$ is an aliphatic acyl group containing 6 to 22 carbon atoms and 0 to 3 double bonds, m is a number of 1 to 3 and $R^2$, $R^3$, n and X are as defined above.

16. The composition of claim 15 containing at least one hydrotrope selected from the group consisting of toluene sulfonate, xylene sulfonate and cumene sulfonate.

17. The composition of claim 16 containing at least one sequestrant selected from the group consisting of inorganic sequestrants selected from the group consisting of alkali metal silicates, alkaline earth metal silicates, alkali metal carbonates, alkaline earth metal carbonates, alkali metal phosphates, alkaline earth metal phosphates, alkali metal phosphonates, and alkaline earth metal phosphonates and organic sequestrants selected from the group consisting of polyacrylates, amine oxide phosphonic acids and lignin sulfonates.

* * * * *